US011964786B2

(12) United States Patent
Gerri

(10) Patent No.: US 11,964,786 B2
(45) Date of Patent: Apr. 23, 2024

(54) FEEDING UNIT FOR FEEDING A PLASTIC FILM IN PACKAGING MACHINES

(71) Applicant: PLUSLINE S.R.L., Bologna (IT)

(72) Inventor: Vittorio Gerri, Bologna (IT)

(73) Assignee: PLUSLINE S.R.L., Bologna (IT)

( * ) Notice: Subject to any disclaimer, the term of this patent is extended or adjusted under 35 U.S.C. 154(b) by 468 days.

(21) Appl. No.: 17/435,473

(22) PCT Filed: Mar. 3, 2020

(86) PCT No.: PCT/IT2020/050046

§ 371 (c)(1),
(2) Date: Sep. 1, 2021

(87) PCT Pub. No.: WO2020/208661

PCT Pub. Date: Oct. 15, 2020

(65) Prior Publication Data

US 2022/0135264 A1 May 5, 2022

(30) Foreign Application Priority Data

Apr. 10, 2019 (IT) ..... 102019000005500

(51) Int. Cl.
*B65B 11/00* (2006.01)
*B65B 25/14* (2006.01)
(Continued)

(52) U.S. Cl.
CPC ..... *B65B 41/16* (2013.01); *B65B 11/004* (2013.01); *B65B 25/146* (2013.01);
(Continued)

(58) Field of Classification Search
CPC . Y10T 83/2192; Y10T 83/889; Y10T 83/896; B65B 41/16; B65B 59/003;
(Continued)

(56) References Cited

U.S. PATENT DOCUMENTS 6,067,780 A 5/2000 Gentili et al.
7,530,442 B2 5/2009 Gerke et al.
2005/0193880 A1* 9/2005 Chao ..... B65B 41/02 83/349

FOREIGN PATENT DOCUMENTS

CA 2070088 A1 12/1992
EP 0 516 991 A1 12/1992
GB 2 379 918 A 3/2003

OTHER PUBLICATIONS

International Search Report and Written Opinion of the International Searching Authority dated Jun. 26, 2020 in corresponding International application No. PCT/IT2020/050046; 10 pages.

* cited by examiner

*Primary Examiner* — Phong H Nguyen
(74) *Attorney, Agent, or Firm* — Maier & Maier, PLLC

(57) ABSTRACT

A feeding unit for feeding a plastic film in packaging machines for wrapping paper rolls, including: a unit for unwinding the film from a reel; a cutting device adapted to cut the film transversely; a transfer device including, on the right and on the left side of the feeding unit, drive belts configured for engaging the upper and lower faces of the film; and a positioning device including, on the right and on the left side of the unit, a predetermined number of drive belts configured for engaging the upper and lower faces of the film. On each side of the feeding unit, the transfer device comprises two pairs of belts. On each side of the feeding unit, the positioning device comprises a third pair of belts. The three pairs of belts are actuated by independent actuators.

7 Claims, 6 Drawing Sheets

(51) Int. Cl.

| | |
|---|---|
| ***B65B 41/16*** | (2006.01) |
| ***B65B 59/00*** | (2006.01) |
| ***B65B 61/06*** | (2006.01) |
| ***B65H 16/08*** | (2006.01) |
| ***B65H 20/02*** | (2006.01) |
| ***B65H 20/06*** | (2006.01) |
| ***B65H 35/00*** | (2006.01) |

(52) U.S. Cl.
CPC ..... *B65B 59/003* (2019.05); *B65B 61/06* (2013.01); *B65H 16/08* (2013.01); *B65H 20/02* (2013.01); *B65H 20/06* (2013.01); *B65H 35/0066* (2013.01); *B65H 2301/122* (2013.01); *B65H 2301/415* (2013.01); *B65H 2301/44316* (2013.01); *B65H 2301/44318* (2013.01); *B65H 2301/51512* (2013.01); *B65H 2513/10* (2013.01)

(58) Field of Classification Search
CPC ..... B65B 11/004; B65H 16/08; B65H 20/02; B65H 20/06; B65H 35/006; B65H 2301/122; B65H 2301/415; B65H 2301/44316; B65H 2301/44318; B65H 2201/51512; B65H 2513/10
See application file for complete search history.

FEEDING UNIT FOR FEEDING A PLASTIC FILM IN PACKAGING MACHINES

FIELD

The present invention relates to a feeding unit for feeding a plastic film in packaging machines intended in particular, although not exclusively, for the packaging of paper rolls.

U.S. Pat. No. 6,067,780 discloses an automatic machine for packaging products such as rolls of paper, using a packaging sheet which is wrapped and folded around the product and sealed on itself. In the packaging machines of the type mentioned above, the packaging is carried out by sequentially feeding the individual products or groups of products along a forming line on which the products advance passing through a series of operating stations in each of which specific operations are carried out to obtain the desired packaging.

BACKGROUND

In general, in the operating stations of an automatic machine for packaging products such as paper rolls, the following operating steps are carried out: the entry into the machine of products surmounted by a sheet of packaging material, in particular a plastic film; wrapping the sheet of packaging material around the products and overlapping the opposite edges of this material under the products and welding the edges; the formation, on said sheet of packaging material, of the closing flaps of the package; folding and sealing said flaps to seal the package thus obtained.

In practice, the paper rolls are held together by a wrapping consisting of the plastic material film (for example, polypropylene or polyethylene) wrapped around the paper rolls and subsequently folded and sealed to form the final package.

A packaging machine structured in this way is served by a feeding unit for feeding the plastic film which is generally placed on a side to the opposite inlet of the rolls to be packed.

The feeding unit comprises unwinding means for unwinding the film from a corresponding reel, a cutting device, a transfer device and a positioning device. The unwinding unit generally comprises a pair of unwinding rollers, between which the film is passed and which are suitably motorized so as to exert a dragging action on the film which determines the unwinding of the film itself from the respective reel. The cutting device is intended to produce a discontinuous incision in the film to create a tear-off line which allows to obtain sheets of a predetermined length from the film. The transfer device is formed by opposing belts, wound in a loop around corresponding guide pulleys, that always have a side oriented along the advancement direction of the film and are mutually arranged so as to engage both sides of the film to guide it between an inlet area, near the cutting device, and an exit area near the positioning device. The latter is arranged downstream of the transfer device and extends to a station of the packaging machine intermediate between the forming line and a lifting station on which the rolls are positioned in the configuration to be packaged. The positioning device consists of opposed motorized belts, wrapped around corresponding pulleys so as to form two horizontal rings developed according to the direction of exit of the film. These belts have opposite transfer sections and are pressed against each other on both sides of the film by means of pressure rollers, so as to transfer the film sheet horizontally to the lift of the lifting station.

The belts of the transfer device are operated at a constant speed, which depends on the production speed of the packaging machine, while the belts of the positioning device are operated with an initial speed lower or equal to the previous one to engage the film and, subsequently, with a much higher speed for cause it to tear and place the sheet thus obtained on the lift of the packaging machine. The length of the sheets varies according to the format of the packages to be produced but the path that each sheet must follow to be positioned on the lift of the packaging machine is always of the same length. Therefore, to respect the production rate of the packaging machine, the shorter sheets are subjected to higher accelerations which subject the film to excessive stress. Furthermore, particularly with shorter sheets, the precision of the positioning of the sheets on the lift of the packaging machine does not always satisfy the current production requirements which are increasingly more strict in relation to the quality of the packaging.

CA2070088 discloses an apparatus for severing sections from a web of material provided with transverse lines of perforations.

SUMMARY

The present invention relates, in particular, to the structure of the film feeding unit in packaging machines of the type described above and it aims at increasing the operating efficiency in the transfer and positioning of the sheets obtained from the packaging film.

This result has been achieved, in accordance with the present invention, by providing a device having the characteristics indicated in claim 1. Other features of the present invention are the subject of the dependent claims.

Thanks to the present invention, it is possible to subject the individual sheets obtained from the film to less stress and, therefore, it is possible to increase production without compromising the quality of the sheets, or, for the same production, it is possible to guarantee a better positioning accuracy of the packaging sheets. Furthermore, an operating unit according to the present invention is relatively simple to manufacture in relation to the advantages offered.

BRIEF DESCRIPTION OF THE DRAWINGS

These and further advantages and characteristics of the present invention will be more and better understood by each person skilled in the art thanks to the description that follows and the annexed drawings, provided by way of example but not to be considered in a limiting sense, in which.

DETAILED DESCRIPTION OF THE EMBODIMENTS

Figure 1:
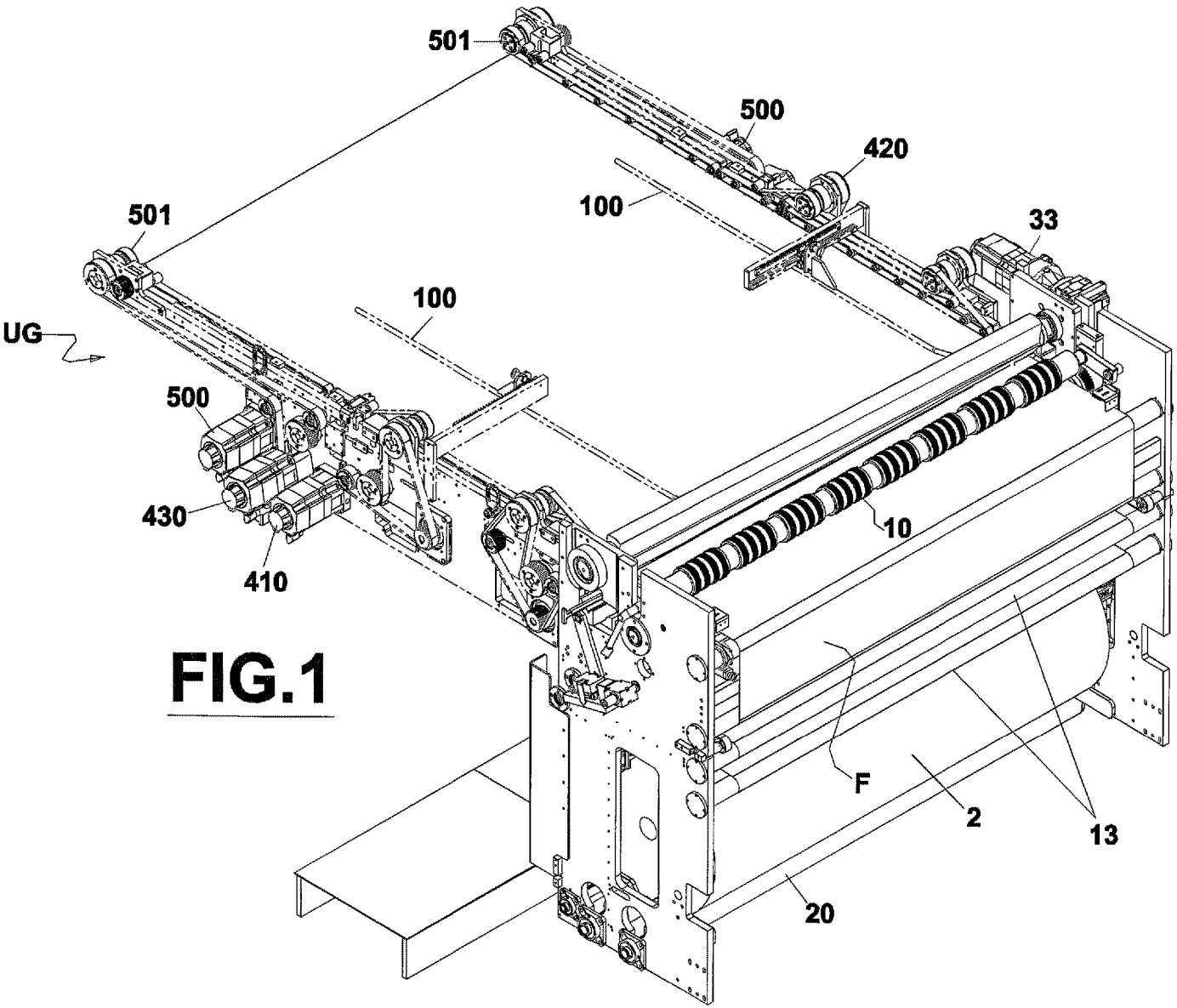
FIG. 1 is a schematic perspective view of a unit for feeding a plastic film in accordance with the present invention.

Reduced to its essential structure and with reference to the figures of the attached drawings, a feeding unit (UG) for feeding a plastic film in packaging machines configured, in particular, for the packaging of paper rolls, in accordance with the present invention comprises:

- a unit (1) for unwinding the film (F) from a corresponding reel (2);
- a cutting device (3) arranged downstream of the unwinding unit (1) with respect to the direction followed by the film (F);
- a transfer device (4) arranged downstream of the cutting device (3);
- a positioning device (5) located downstream of the transfer device (4).

The unwinding unit (1) comprises a pair of horizontal unwinding rollers (10, 11) which define a nip (N) that can be crossed by the film (F) and which are suitably motorized so as to exercise, in cooperation with each other, a dragging action on the film which causes the unwinding of the film itself from the reel (2). With methods known to those skilled in the art, the unwinding rollers (10, 11) are driven, by means of a programmable control unit, for a time related to the unwinding of an amount of film of a predetermined length. The reel (2) rests on a base comprising two horizontal axis support rollers (20) by means of which the reel is rotated around its own axis to allow the film (F) to unwind from the reel. The rollers (20) are arranged between two flanks (12) of the unwinding unit and are enslaved to a respective electric motor (200) that controls their rotation with a predetermined angular speed. The unwinding rollers (10, 11) are also arranged on the same flanks (12). The axes of the reel (2), of the unwinding rollers (10, 11) and of the support rollers (20) are parallel to each other and orthogonal to said flanks (12). The unwinding rollers (10, 11) are on the opposite side of the support rollers (20) with respect to the reel (2). The flanks (12) define the right and left side of the unit (UG).

Several guide rollers (13) are arranged between the unwinding rollers (10, 11) and the reel (2), parallel to the unwinding rollers (10, 11), by means of which the film (F) unwound from the reel (2) is guided up to the unwinding rollers. Between the reel (2) and the unwinding rollers (10, 11) one or more tensioning rollers or "dancers" (130) can also be arranged to adjust the tension of the film (F) according to methods known to those skilled in the art.

A photocell (FC), positioned upstream of the unwinding rollers (10, 11) both on the right and on the left side of the unit (UG), is provided for detecting the passage of the film (F) with known methods, by reading marks formed on the side edges of the film.

The cutting device (3), that is known per se to those skilled in the art, serves to produce a discontinuous incision in the film (F) to create a tear-off line which allows to obtain sheets of predetermined length from the same film. In the example shown in the drawings, the cutting device (3) comprises a scoring roller (30) arranged downstream of the aforesaid nip (N) with respect to the direction followed by the film (F). The scoring roller (30) is parallel to the unwinding rollers (10, 11), is provided with a blade (32) configured to engrave the film (F) as previously said, is driven by a corresponding electric motor (33), and cooperates with an underlying fixed counter-blade (34) to produce the discontinuous incision on the film (F).

The transfer device (4), so called because it controls the transfer of the film from the unwinding unit (1) to the positioning device (5), includes, both on the right and on the left side of the unit (UG), two opposite belts (40, 41), wound around corresponding pulleys and driving rollers, that always have a side facing the advancement direction (A) of the film (F) and are mutually arranged to engage both sides of the film so as to guide it between an entrance area (H), near the cutting device (3), and an exit area at a predetermined distance from the entrance area. With reference to the example shown in the drawings, the upper belts (40) are controlled by the motor electrical (410) that drives the pulley (401) through the transmission (400). The pulley (401) transmits the motion to the upper belts (40) which are held and guided by the rollers (402) aligned parallel to the aforementioned direction (A). The lower belts (41) are also driven by the electric motor (410) on which is mounted the pulley (411) that transmits the motion to the lower belts (41), which are held and guided by the rollers (412) also aligned parallel to the aforementioned direction (A). The lower belts (41) have an input side closer to the cutting device (3) than the upper belts (40) so as to form an input area (H) for the film (F) which, immediately downstream of the cutting device (3), is formed only by the lower belts (41) to facilitate the entry of the film (F) into the transfer device (4). The motor (410) and the rollers (402, 412) are integral with the flanks (12) of the unit (UG).

The transfer device (4) further comprises, on both the right and left side of the unit (UG), two additional opposite belts (42, 43) arranged downstream of the others (40, 41) with respect to the direction (A) followed by the film (F) in the unit (UG). The additional belts (42, 43) are also mutually arranged so that they can engage both sides of the film (F).

Figure 2:
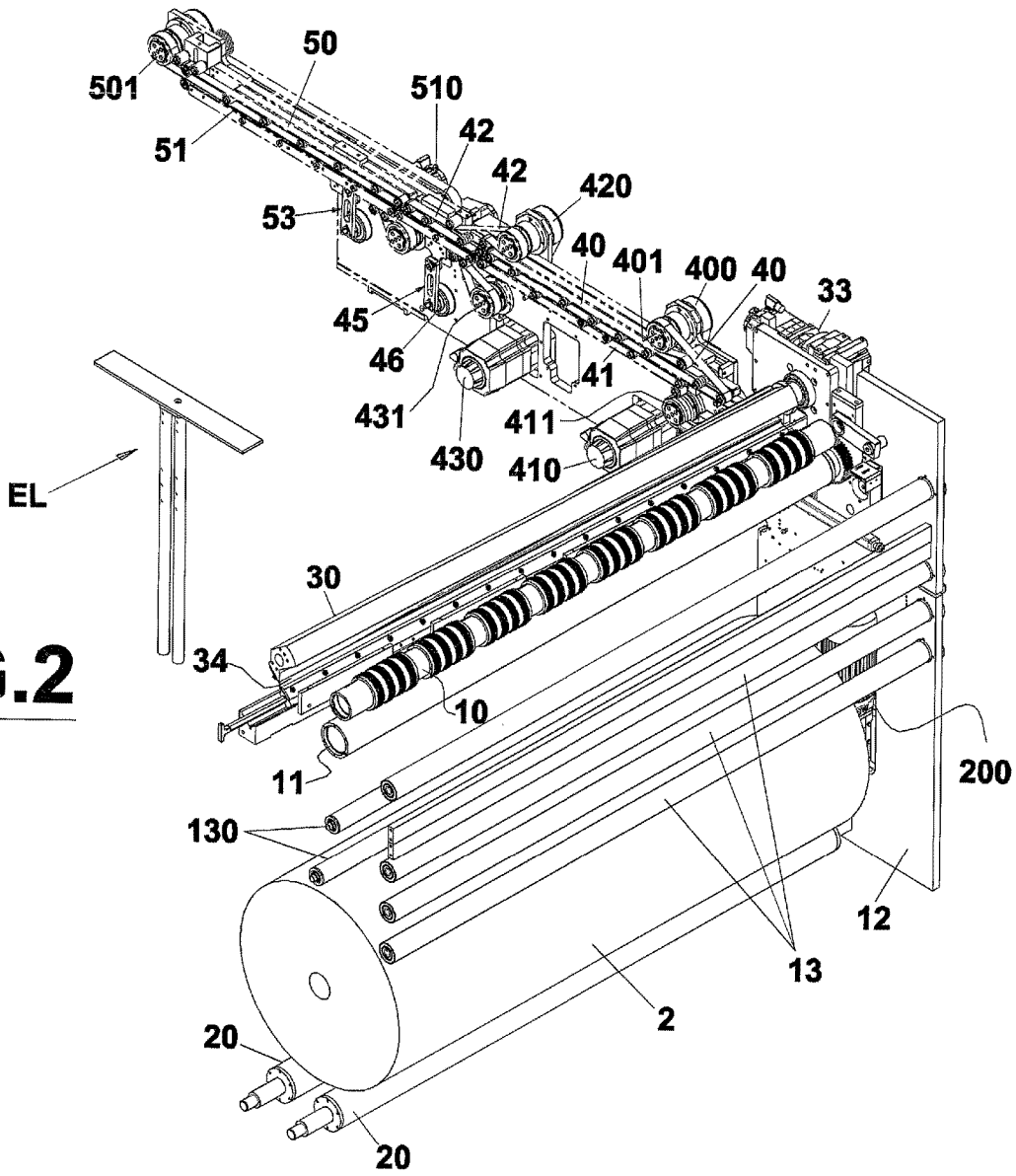
FIG. 2 represents the feeding unit of FIG. 1 with parts removed to better highlight others.
Figure 3:
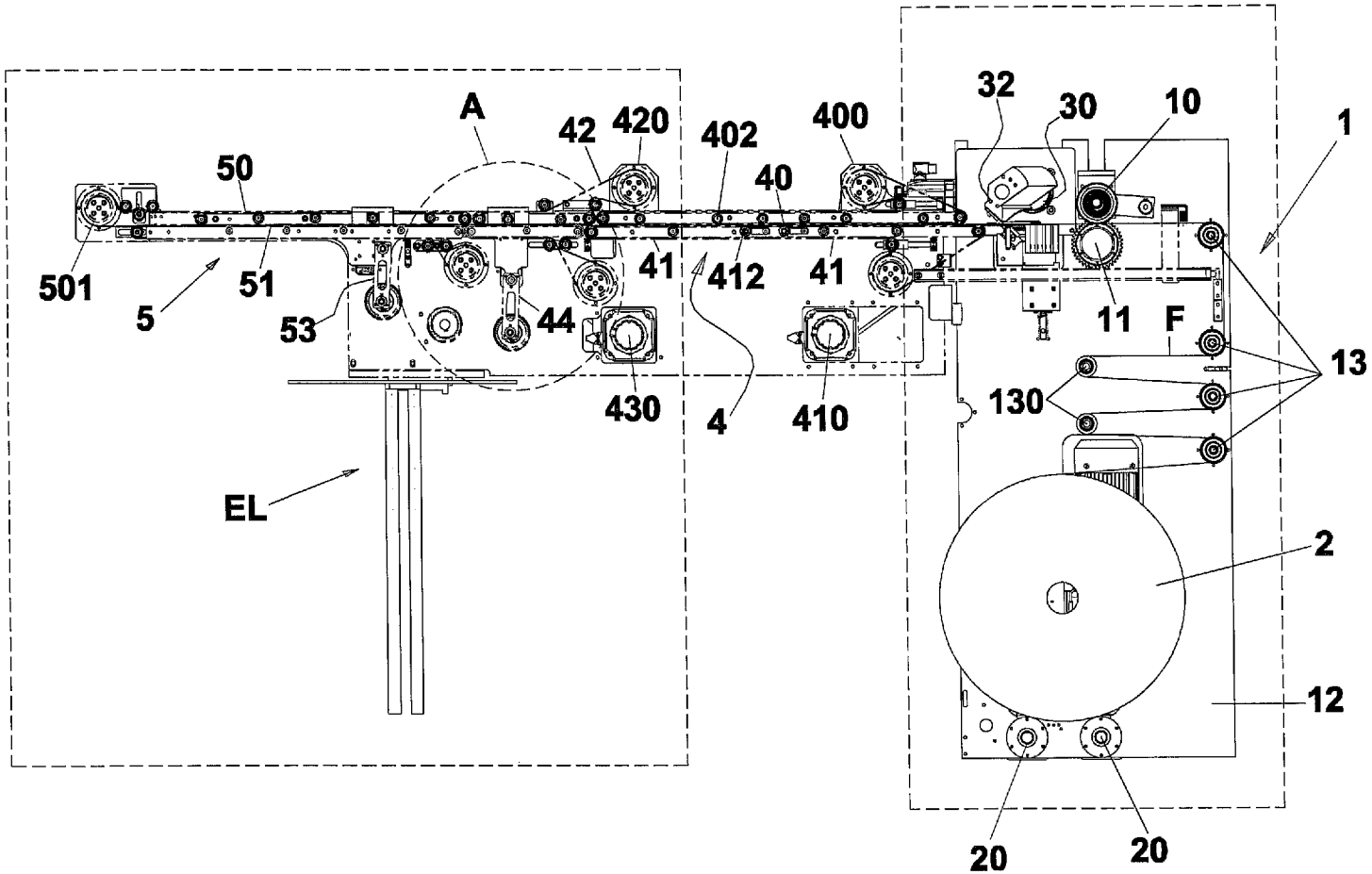
FIG. 3 is a side view of the assembly shown in FIG. 2.
Figure 4:
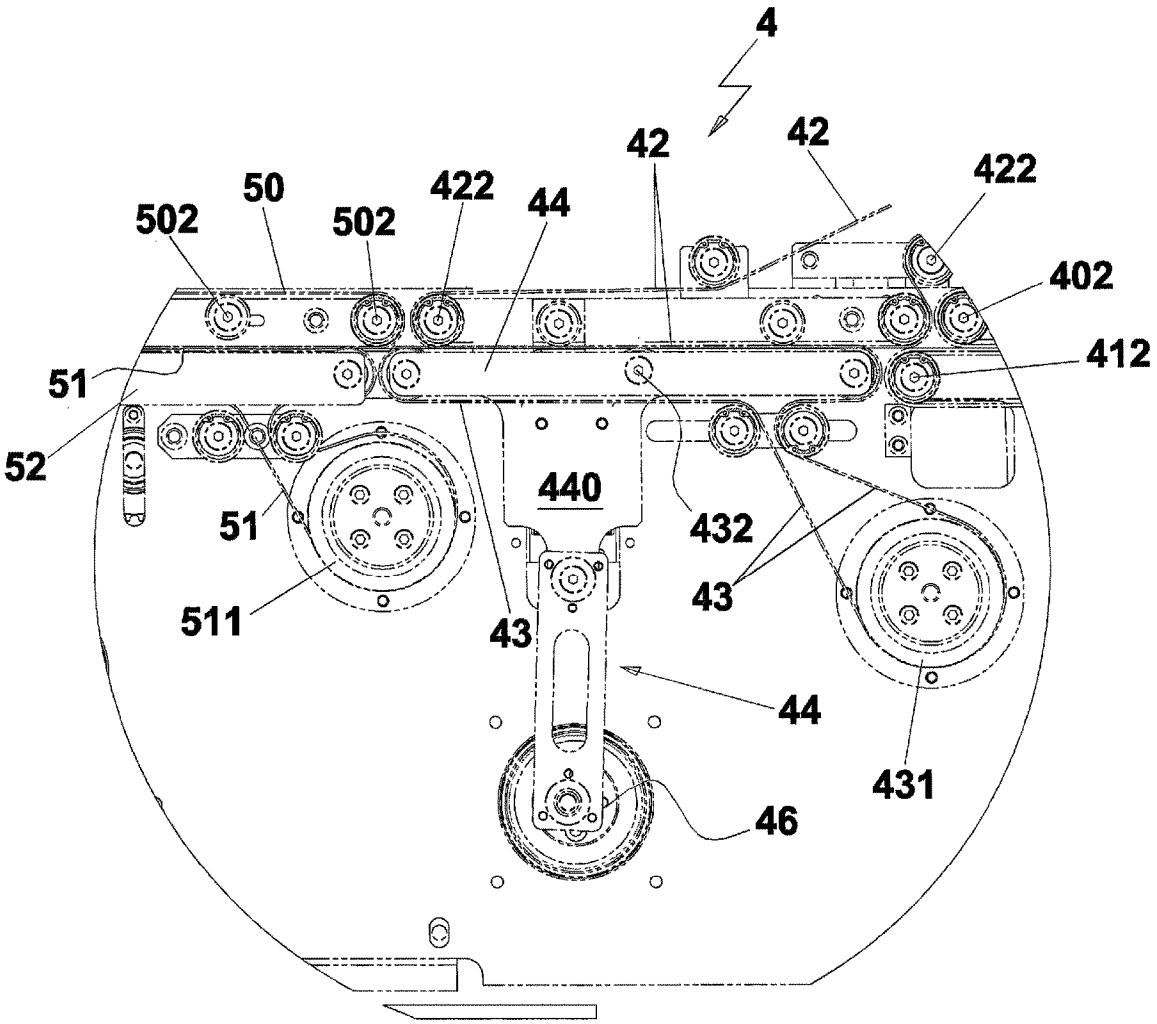
FIG. 4 is an enlarged detail of FIG. 3.
Figure 5:
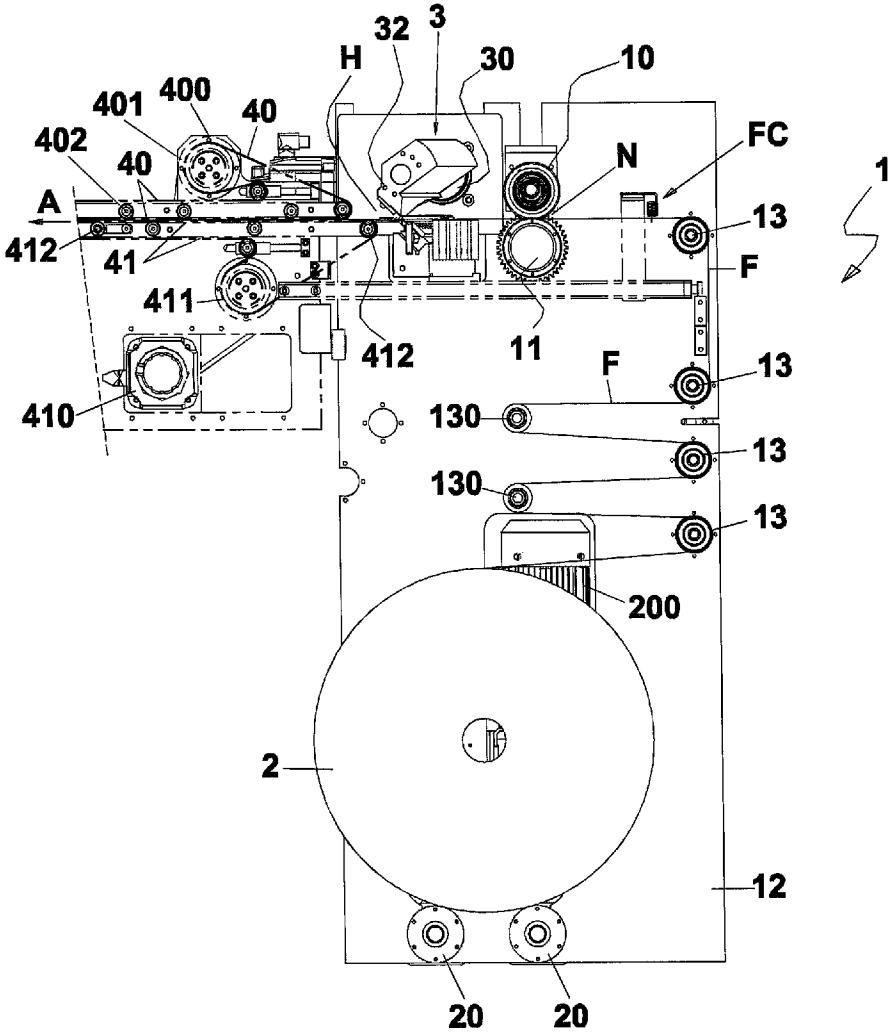
FIG. 5 is an enlarged detail of FIG. 3.
Figure 6:
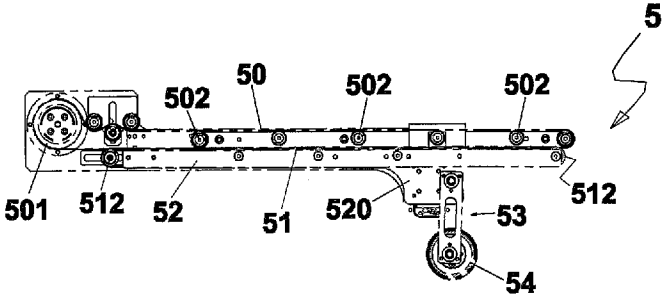
FIG. 6 is an enlarged detail of FIG. 3.
Figure 7:
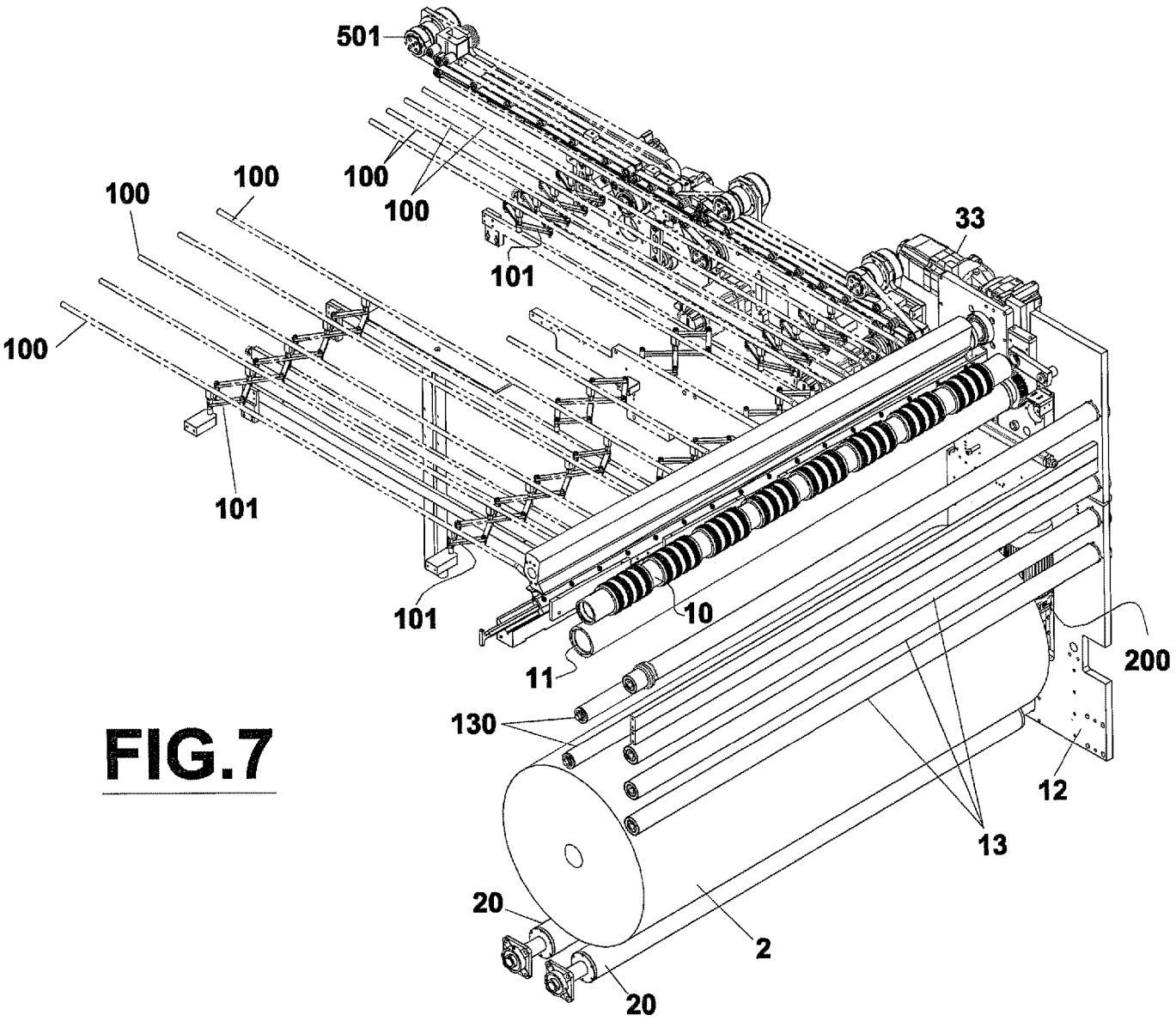
FIG. 7 is similar to FIG. 2 but it illustrates further elements of the unit.

With reference to the example shown in the drawings, the upper belts (42) are driven by the electric motor (430) to which the pulley (420) is connected, which transmits the motion to the upper belts (42) kept in guide by the rollers (422) aligned along the direction (A). The lower belts (43) are also driven by the electric motor (430) on which the pulley (431) is mounted, which transmits motion to the lower belts (43) kept in guide by the rollers (432) also aligned according to direction (A). The motor (430) and the rollers (422) are integral with the flanks (12) of the units (UG). The rollers (432) which guide the lower belts (43) are mounted on a support (44) connected to a rod-crank mechanism (45) which, driven by a corresponding electric motor (46) partially visible in FIG. 2, cyclically determines the approach of the lower belts (43) to the upper belts (42) and, respectively, their mutual distancing as further described below. Said support (44) is constrained to the respective flank (12) of the group (UG). The support (44) is connected to the mechanism (45) by means of a corresponding lower appendix (440).

In practice, the device (4) is formed, on each side of the unit (UG), by two pairs of opposite belts (40, 41; 42, 43) arranged in cascade along the direction (A) followed by the film (F). In other words, the device (4) is divided into two sections, the first one comprising the belts (40, 41), the second comprising the belts (42, 43), operated independently by respective electric motors.

The positioning device (5), so called because it is intended to position the sheets obtained from the film (F) on the lift (EL) normally arranged in the packaging machine, is arranged downstream of the transfer device (4) with respect to the direction (A) of the film in the unit (UG), and extends to a station of the packaging machine intermediate between the forming line and a lift on which the rolls are positioned in the configuration to be packaged. In accordance with the example shown in the drawings, the positioning device (5) comprises, on both the right and left side of the unit (UG), two opposite belts (50, 51) which form two horizontal rings developed according to the direction of exit of the film. In accordance with the example shown in the drawings, the upper belts (50) are driven by the electric motor (500) on which the pulley (501) is mounted, which transmits the motion to the upper belts (50) kept in guide by the rollers (502) aligned along the aforementioned direction (A). The lower belts (51) are also driven by the electric motor (500) on which the pulley (511) is mounted, which transmits motion to the lower belts (51) kept in guide by the rollers (512) also aligned according to the aforementioned direction (A). The motor (500) and the rollers (502) are integral with the flanks (12) of the unit (UG). The rollers (512) which guide the lower belts (51) are mounted on a support (52) connected to a rod-crank mechanism (53) that, operated by a corresponding electric motor (54), cyclically determines the approach of the lower belts (51) to the upper belts (50) and, respectively, their mutual distancing. Said support (52) is constrained to the respective flank (12) of the unit (UG). With respect to the direction (A) of advancement of the film (F), the support (52) has a rear side with a lower appendix (520) connected to the mechanism (53) and an opposite front side facing the zone (E) of exit of the film (F) from the unit (UG). Therefore, the distance between the belts (50, 51) as well as the distance between the belts (42, 43) can be controlled. In particular, these distances can be changed cyclically during the operation of the machine, thanks to the mechanisms (45) and (53) which constitute means for obtaining a cyclic variation of these distances.

A possible way of operating the machine described above is the following.

For the treatment of shorter sheets (that is, for example, sheets between 240 mm and 500 mm in length), the length of which is determined in any case, as for the longest sheets, by the intervention of the transversal perforation means, the distance between the belts (42, 43) initially equals the distance between the belts (40, 41). In this phase, the belts (42, 43) have a first speed which is equal to the speed of the belts (40, 41) and this speed configuration is maintained until the belts (42, 43) have engaged a section of predetermined length (for example, 80 mm) of the sheet. At this point, the mechanism (45) intervenes and causes a greater tightening of the belts (42, 43) on the film and the same belts (42, 43) undergo an acceleration until a second speed is reached and this causes the film to tear at the previously performed transverse perforation. In this way, the belts (42, 43), maintaining the second speed, lead the sheet to the belts (50, 51) which then determine the positioning of the sheet on the elevator (EL). Therefore, the belts (50, 51) are not obliged to follow the acceleration/deceleration ramps typical of traditional systems and the sheet is subjected to less stress without deteriorating, which implies the possibility of treating a greater number of sheets in a same time interval, with consequent increase in machine production.

When the sheets are longer (for example, sheets having a length between 500 and 1100 mm), the operation of the belts (50, 51) is identical to that of the traditional machines as regards the acceleration/deceleration ramps and the intermediate belts (42, 43) constitute a back extension of the belts (50, 51), in the sense that they are controlled like the belts (50, 51).

The phase of positioning the sheets obtained from the film (F) on the elevator (EL) takes place with methods known to those skilled in the art, as well as the subsequent phase of use of the sheet by the packaging machine.

In a manner known per se, the flanks of the unit (UG) can be spaced according to the width of the film used. Downstream of the cutting device, the unit (UG) has a plurality of rods (100) parallel to each other and oriented according to the direction (A) of advancement of the film (F), which are constrained to respective support pantographs (101) allowing variations of their mutual distance. In this way, a sliding plane for the film (F) is formed, the width of which can be adjusted according to the width of the film.

The motors that drive the belts (40, 41; 42, 43; 50, 51) on the right side of the unit (UG) are controlled independently with respect to the corresponding motors on the left side to allow compensation, according to methods known to those skilled in the art, of possible misalignments of the film (F) with respect to the predetermined direction (A) of advancement of the film.

From the foregoing description, it is evident that, in accordance with the present invention, a feeding unit (UG) for feeding plastic film in packaging machines intended, in particular, for wrapping paper rolls, comprises:

a unit (1) for unwinding the film (F) from a corresponding reel (2);

a cutting device (3) arranged downstream of the unwinding unit (1) with respect to the direction followed by the film (F) along an exit path from the unwinding unit and configured for transversely incising the film to allow to obtain sheets of predetermined length;

a transfer device (4) arranged downstream of the cutting device (3) and comprising, both on the right and on the left side of the feeding unit, a predetermined number of drive belts configured for engaging both the upper and lower faces of the film; and a positioning device (5) located downstream of the transfer device (4) and comprising, both on the right and on the left side of the feeding unit, a predetermined number of drive belts suitable for engaging both the upper and lower faces of the film;

in which both on the right and on the left side of the feeding unit (UG), the transfer device (4) comprises two pairs of belts (40, 41; 42, 43) arranged on opposite sides with respect to the path followed by the film (F), with a first pair of belts (40, 41) arranged immediately downstream of the cutting device (3) and a second pair of belts (42, 43) arranged immediately downstream of the first pair of belts (40, 41); and both on the right side and on the left side of the feeding unit (UG), the positioning device (5) comprises a third pair of belts (50, 51) arranged on opposite sides with respect to the path followed by the film, said belts (50, 51) being arranged immediately downstream of said second pair of belts (42, 43) of the transfer device (4).

The subdivision of the belts of the transfer device into a first and a second pair on each side of the group (UG) allows to obtain the previously mentioned advantages.

In practice, the details of execution may in any case vary in an equivalent manner as regards the individual elements described and illustrated, without thereby departing from the scope of the solution idea adopted and therefore remaining within the limits of the protection offered by this patent in accordance with the following claims.

The invention claimed is:

1. A feeding unit for feeding a plastic film in packaging machines configured for the packaging of paper rolls, comprising:

a unit for unwinding the film from a corresponding reel;

a cutting device arranged downstream of the unwinding unit with respect to the direction followed by the film along an exit path from the unwinding unit and configured for transversely incising the film to allow to obtain sheets of predetermined length;

a transfer device arranged downstream of the cutting device and comprising, both on the right and on the left side of the feeding unit, a predetermined number of drive belts configured for engaging both the upper and lower faces of the film; and a positioning device located downstream of the transfer device and comprising, both on the right and on the left side of the feeding unit, a predetermined number of drive belts suitable for engaging both the upper and lower faces of the film;

wherein both on the right and on the left side of the feeding unit, the transfer device comprises two pairs of belts arranged on opposite sides with respect to the path followed by the film, with a first pair of belts arranged immediately downstream of the cutting device and a second pair of belts arranged immediately downstream of the first pair of belts; and both on the right side and on the left side of the feeding unit, the positioning device comprises a third pair of belts arranged on opposite sides with respect to the path followed by the film, said belts being arranged immediately downstream of said second pair of belts of the transfer device;

both on the right side and on the left side of the feeding unit said three pairs of belts are driven by respective independent actuators; and the right side and the left side are defined by two flanks parallel to a direction of advancement of the film, and the distance between the said sides can be adjusted according to the film width.

2. Feeding unit according to claim 1, wherein the unwinding unit comprises a pair of horizontal unwinding rollers that define a nip which can be crossed by the film, said rollers being motorized so as to exercise, in cooperation with each other, a dragging action on the film which determines the unwinding of the film from the reel.

3. Feeding unit according to claim 1, further comprising a support base for the reel with two horizontal axis support rollers through which the reel is rotated around its own axis to allow the unwinding of the film from the reel, said rollers being connected to a respective electric motor that controls their rotation with predetermined angular speed.

4. Feeding unit according to claim 1, wherein said independent actuators are electric motors.

5. Feeding unit according to claim 1, wherein the distance between the belts of said second pair of belts varies cyclically between a minimum and a maximum value.

6. Feeding unit according to claim 1, wherein the distance between the belts of said third pair of belts varies cyclically between a minimum and a maximum value.

7. Feeding unit according to claim 1, further comprising feeds sheets, made from said film, of a length between 240 mm and 1100 mm.

* * * * *